US009994966B2

(12) United States Patent
Morawitz et al.

(10) Patent No.: US 9,994,966 B2
(45) Date of Patent: Jun. 12, 2018

(54) METHOD FOR PRODUCING A COATED SURFACE OF A TRIBOLOGICAL SYSTEM

(71) Applicants: FORD WERKE GMBH, Cologne (DE); HENKEL AG & CO. KGAA, Dusseldorf (DE)

(72) Inventors: Urban Morawitz, Cologne (DE); Clemens Verpoort, Monheim am Rhein (DE); Christian Rosenkranz, Dusseldorf (DE); Gerhard Flores, Ostfildern (DE); Andreas Wiens, Stuttgart (DE); Andreas Wagner, Esslingen (DE)

( * ) Notice: Subject to any disclaimer, the term of this patent is extended or adjusted under 35 U.S.C. 154(b) by 0 days. days.

(21) Appl. No.: 15/036,111

(22) PCT Filed: Nov. 11, 2014

(86) PCT No.: PCT/DE2014/000574

§ 371 (c)(1),
(2) Date: May 12, 2016

(87) PCT Pub. No.: WO2015/070833

PCT Pub. Date: May 21, 2015

(65) Prior Publication Data

US 2016/0289856 A1 Oct. 6, 2016

(30) Foreign Application Priority Data

Nov. 12, 2013 (DE) ..... 10 2013 223 011

(51) Int. Cl.

| | |
|---|---|
| ***C25D 5/34*** | (2006.01) |
| ***C25D 5/48*** | (2006.01) |
| ***C25D 5/52*** | (2006.01) |
| ***C25D 11/02*** | (2006.01) |
| ***C25D 11/08*** | (2006.01) |
| ***C25D 11/16*** | (2006.01) |
| ***C25D 11/18*** | (2006.01) |

(Continued)

(52) U.S. Cl.

CPC ..... *C25D 5/34* (2013.01); *C25D 9/04* (2013.01); *C25D 11/026* (2013.01); *C25D 11/08* (2013.01); *C25D 11/16* (2013.01); *C25D 11/18* (2013.01); *C25D 11/022* (2013.01); *F02F 1/20* (2013.01)

(58) Field of Classification Search

CPC ..... C25D 11/16; C25D 11/18
USPC ..... 205/206, 222, 229
See application file for complete search history.

(56) References Cited

U.S. PATENT DOCUMENTS 5,691,004 A * 11/1997 Palazzolo ..... C23C 4/02 427/236
7,578,921 B2 8/2009 Dolan
(Continued)

FOREIGN PATENT DOCUMENTS

CA 2556869 A1 2/2008
DE 19506656 A1 * 8/1996 ..... C25D 11/04

OTHER PUBLICATIONS

Zhang et al., "Preparation and Tribological Properties of Thin Oxide Coatings on Al383/SiO2 Metallic Matric Composite," Surface & Coatings Technology (no month, 2010), vol. 205, pp. 1689-1696.*
(Continued)

*Primary Examiner* — Edna Wong
(74) *Attorney, Agent, or Firm* — Dickinson Wright PLLC

(57) ABSTRACT

A method is proposed for producing a cylinder working surface of an internal combustion engine that is optimized in terms of friction and wear.

11 Claims, 4 Drawing Sheets

(51) Int. Cl.
*C25D 9/04* (2006.01)
*F02F 1/20* (2006.01)

(56) References Cited

U.S. PATENT DOCUMENTS

| | | | | |
|---|---|---|---|---|
| 2003/0164150 | A1* | 9/2003 | Barbezat | C23C 4/16 123/193.2 |
| 2010/0032301 | A1* | 2/2010 | Hiratsuka | C25D 11/06 205/50 |
| 2012/0216771 | A1* | 8/2012 | Daiker | C23C 4/04 123/193.2 |
| 2013/0015072 | A1 | 1/2013 | Hiratsuka et al. | |

OTHER PUBLICATIONS

Shabel et al., "Friction and Wear of Aluminum-Silicon Alloys," ASM Handbook (© no month, 1992), vol. 18: Friction, Lubrication and Wear Technology, P.J. Blau, editor, pp. 785-794.*

Su et al., "Friction and Counterface Wear Influence by Surface Profiles of Plasma Electrolytic Oxidation Coatings on an Aluminum A365 Alloy," J. Vac. Sci. Technol. A (Nov./Dec. 2012), vol. 30, No. 6, pp. 1-11.*

Zhang et al., "Preparation and Tribological Properties of Thin Oxide Coatings on Al383/SiO2 Metallic MatriC Composite," Surface & Coatings Technology (no month, 2010), vol. 205, pp. 1689-1696. (Year: 2010).*

Shabel et al., "Friction and Wear of Aluminum-Silicon Alloys," ASM Handbook (© no month, 1992), vol. 18: Friction, Lubrication and Wear Technology, P. J. Blau, editor, pp. 785-794. (Year: 1992).*

International Search Report, dated Mar. 2, 2015, 3 Pages.

* cited by examiner

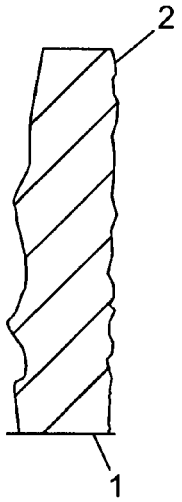
Fig. 1
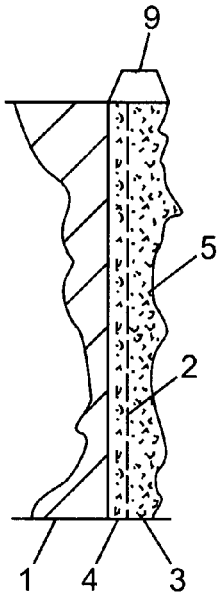
Fig. 2
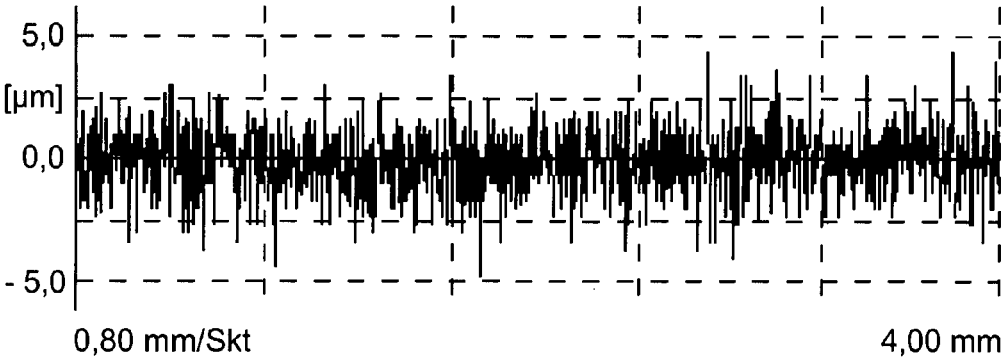
Fig. 2.1

Fig. 2.2

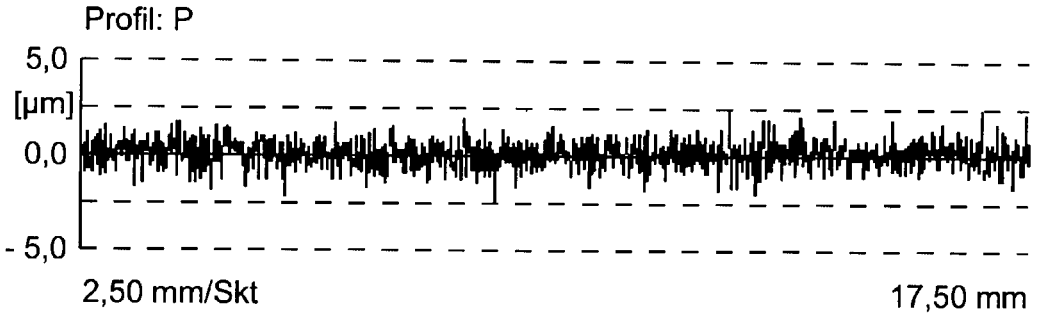
Fig. 3.1
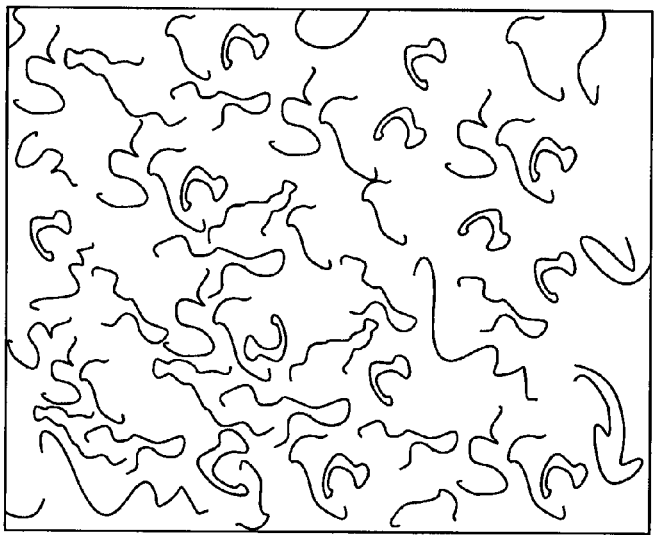
Fig. 3.2

METHOD FOR PRODUCING A COATED SURFACE OF A TRIBOLOGICAL SYSTEM

CROSS REFERENCE TO RELATED APPLICATIONS

This application claims the benefit of PCT International Application Serial No. PCT/DE2014/000574 filed on Nov. 11, 2014, which claims priority to German Application Serial No. 10 2013 223 011.7 filed on Nov. 12, 2013. The entire disclosure of the above applications are incorporated by reference.

The invention relates to a method for producing a coated surface of a cylinder working surface that is optimized in terms of friction and wear, and developed against the background of growing demands for a reduction in CO2 emissions in internal combustion engines of motor vehicles.

By reducing the friction of the tribological system of "cylinder bore and piston rings", fuel consumption and thus also the exhaust emissions of the internal combustion engine fall.

In order to achieve reduced friction, a nickel-silicon-carbide dispersion layer (NiSiC) was galvanically deposited in the cylinder bore, for example. This composite material is very low in friction and wear-resistant owing to its hardness. Since the galvanic process requires very long coating times, this method can only be used in small-batch production for sports-car engines and racing-car engines.

Likewise, thermal coating methods are used (see e.g. DE 10 2007 023 297 A1 or U.S. Pat. No. 5,691,004) in which the coating material in the form of an alloyed wire or a heterogeneous powder is melted, and individual molten particles are centrifuged at high velocity against the cylinder wall and thus build up a thermal spray layer. These layers are very expensive to manufacture and cause high thermal stress on the cylinder block. As a result, the cylinder block may distort, which is undesirable. This effect occurs in particular in weight-optimized and thus thin-walled cylinders.

Furthermore, all the thermal methods have the drawback that further processing is delayed by cooling phases owing to the high block temperatures after coating and, owing to the surface structure and the hardness of the applied coating, cost-effective finish-boring of the coated bores is not possible due to subtopographical layer damage and high levels of tool wear.

The problem addressed by the invention is to provide a method of workpieces made of aluminum that is cost-effective and suitable for large-batch production, and that leads to a wear-resistant surface while at the same time having good oil retention.

In addition, good heat transfer is intended to be ensured.

This problem is solved according to the invention by a method comprising at least two process steps, which for an aluminum cylinder block lead to wear-resistant and friction-optimized topography of the cylinder bore. The invention may comprise one or more of the following features. A method for producing a wear-resistant surface of a workpiece (1) made of aluminum or an aluminum alloy, comprising the steps of: premachining and activating the surface by honing or precision boring, and applying a wear-resistant coating (9) by means of electrolysis. A method according to the preceding method, characterized in that the wear-resistant coating (9) is produced by plasma electrolytic deposition (PED) or plasma electrolytic oxidation (PEO). A method according to one of the preceding methods, characterized in that, after the wear-resistant coating (9) is applied, the surface is smoothed, while the porosity of the coating (9) is retained. A method according to the previous method, characterized in that the surface of the coating (9) is smoothed by honing, in particular smooth honing, or brushing. A method according to the preceeding methods, characterized in that less than 5 μm, and based on the diameter of a cylinder bore (1) less than 10 μm, is removed during smoothing. A method according to one of the preceding methods, characterized in that the surface preferably undergoes alkaline degreasing between the coating (9) being activated and applied. A method according to one of the preceding methods, characterized in that a cylindrical surface is produced during premachining. A method according to one of the preceding methods, characterized in that said method is used to coat a workpiece (1) made of a hypoeutectic aluminum alloy. A method according to one of the preceding methods, characterized in that said method is used to produce the cylinder bore (1) of an internal combustion engine.

The starting point for the method according to the invention is a relatively roughly machined cylinder bore, which is in form of a monolithic aluminum block or an inserted wet or dry lining. In each case, the surface to be machined consists of an aluminum alloy, usually of hypoeutectic aluminum.

In the first step of the method according to the invention (premachining), the surface is brought into the desired shape by honing or precision boring and is machined almost to the final dimensions. The (still) untreated aluminum can be very easily and cost-effectively machined. It is possible to produce a cylindrical shape during premachining. A method suitable therefor is precision boring. This target shape is only slightly altered by the subsequent coating according to the invention.

Since the electrolytically applied layer is very thin, dimensional correction is virtually impossible. Therefore, the final dimensions must almost be reached during premachining.

However, by means of premachining, not only is the desired target shape produced, but also the surface is prepared for the subsequent coating.

In particular, the roughness produced in the first process step has an influence on the final quality after coating.

Roughness in the range of between 1-4 μm Rz has proved to be suitable. Accordingly, diamond grain sizes of from 010 to 046 have bean used during honing.

Before producing the coating, the surface is generally still degreased.

The coating applied subsequently by electrolysis reproduces the premachined (target) shape equidistantly, and therefore the shape produced by the first process step is largely retained.

In the second process step, a wear-resistant coating is applied of produced by electrolysis. In this case, there is no distortion to the workplace and the target shape of the surface is not changed.

This layer has a high hardness and is therefore very wear-resistant. By selecting the process parameters during electrolysis, the porosity of the layer can be set in a targeted manner. The porosity improves oil retention, reduces wear due to sliding friction and assists hydrodynamics lubrication.

The high hardness reduces sliding friction in the mixed-friction range at lower motor speeds and increases the service life.

In addition, the heat transfer between the coating and the substrate made of aluminum (cylinder block or lining) is very good.

Here, various electrolytic costing technologies are used to produce oxide-ceramic layers: plasma electrolytic oxidation (PEO), also known as micro are oxidation (MAO). In the known PEO plasma oxidation methods, the layers formed consist of oxides of the substrate material, i.e. in this case of aluminum oxide.

A particularly preferable electrolytic method is plasma electrolytic deposition (PED), which is carried out in an aqueous electrolyte and brings about both a change in the rim zone on the inside and a layer build-up on the outside.

Another advantage of PED consists in that in addition to said layers of aluminum oxide, other metal-oxide layers such as titanium-oxide layers (TiO2) can also be produced. A suitable method is known from U.S. Pat. No. 7,578,921, B2.

The coatings produced in this way have a changed rim zone on the inside having a penetration depth of e.g. 3 μm and a layer build-up on the outside of e.g. 9 μm, and therefore a layer thickness of 12 μm results in this case. The layers thicknesses that are typically used are significantly lower than 70 μm, and their hardness is up to 1500 HV. The hardness and topography of the coating can be set by means of the electrical process parameters for the electrolysis.

The coating process takes piece in an electrolytic bath. In the process, the workplace is largely masked, such that only the bore to be coated is in contact with the electrolyte, and therefore it is possible to selectively coat the bore.

The masking is for example carried out by means of a lid, which, being sealed with O rings, seals the bore off from the crankcase.

The electrode is preferably designed as a cylinder, which is approximately the length of the cylinder bore to be machined and is dimensioned such that there is a radial gap having a thickness of approximately 20-30 mm between the electrode and the cylinder bore. For a cylinder bore for a motor-vehicle engine, the electrolyte flows through this gap at a volume flow rate of e.g. 20 l/min, is defected by the lid and flows towards the sealing surface for the cylinder head again.

The electrode is cathodically polarized, and the workplace is anodically polarized. A pulsed DC current having a voltage of 400-500 voll is applied between the electrode and the cathode. The electrolysis may also be carried out using an unpulsed DC current, with or without an overlaid alternating current component.

Current densities of approximately 10-30 A/dm2 have proved to be suitable. The coating time is approximately 2-10 minutes; the coating can be carried out simultaneously on all the cylinders of a block using a plurality of electrodes.

The layer thickness, the resulting layer roughness and the pore size are dependent on the electrical current applied, the voltage, the pulse program used and the coating time.

The coating generally has a roughness of 2-3 μm Rz and an Rpk value of e.g. 1.0-2.0 μm at a pore size of 2-3 μm.

Irrespective of the total layer thickness, it can be generally stated that the depth of the change in the rim zone in the material of the workplace is approximately ⅓ of the layer that has built up on the outside. For a total layer thickness of 20 μm, the change in the rim zone on the inside is e.g. approximately 5 μm and the layer build-up on the outside is approximately 15 μm into the bore.

The stated roughness of the layer consists of undulations caused by the pores and the texture of the layer. In an additional, optional step, if required, the coating therefore undergoes a finishing operation using a smoothing process, in order to even out the undulations which have developed during coating. If the undulations are minor, the smoothing process can be omitted.

The smoothing machining may be carried out by honing or brushing, in order to even out the undulations in the layer, conventional honing tools may be used. However, in order to minimize the amount of material removed and to only minimally change the (free) shape of the surface, it is recommended that special smooth-honing tools are used. The freely suspended (honing) stone segments of said tools are relatively short compared with the length of the cylinder bore, but longer than the shallowly undulating portions of the coating profile, and as a result produce the desired smoothing without significantly changing the geometry of the cylinder bore, with there being a minimal amount of material removed at the same time.

As the length of the individual stone segments increases, the surface line is straightened out to a greater extent.

Alternatively, it is also possible to use honing brushes, which also adapt to the undulations owing to their flexibility. These are brushes of which the individual bristles consist of polyamide, for example, and into which bristles abrasive hard materials, such as silicon carbide, corundum or diamond grain, are embedded.

Flexible honing brushes may also be used, which are for example equipped with ceramic-bonded, outing-material-containing nodules at the ends of the bristles.

In all smoothing variants, it is important that the undulations in the surface are reduced with the lowest possible amount of material removal, and therefore a cylinder working surface in which the surface line is as straight as possible is achieved. Over the diameter, a smooth-honing machining allowance of less than 10 μm is removed.

During smooth-honing, the porosity of the layer, and as a result the oil retention, is largely retained.

Altogether, the finished honed and smoothed layer topography is overlaid with the roughness before coating and with the layer-specific pores.

In the process, the roughness profile changes, starting from the above-mentioned values after coating, to Rz values of 2.0-2.5 after smoothing. A suitable Rpk value is 0.13 μm.

Metal-bound diamond grains and ceramic-bound corundum or SIC grains have proved to be suitable as cutting materials.

In summary, it can be stated that, using the method according to the invention, a layer which is particularly tribologically suitable swing to its pore structure and the high material hardness can be produced in a well-controlled manner in terms of manufacturing.

The heat dissipation from the combustion chamber via the layer is particularly effective, since the layer has been applied semi-galvanically and therefore has bound to the substrate in an optimal manner.

In addition, the layer according to the invention does not influence the geometry of the cylinder bore, or only slightly influences said geometry, and therefore the target shape can already be completed before coating. In this process, the deposition resulting from the coating and the material removal arising from optimal smoothing of course have to be taken into account.

Overall, the method according to the invention can be implemented in a compact manufacturing chain that is highly efficient in terms of coats and technology.

In the drawings:

FIG. 1 shows the bore surface line after pre-treatment by precision boring or honing;

FIG. 2 shows the bore surface line with a layer applied;

Figure 3:
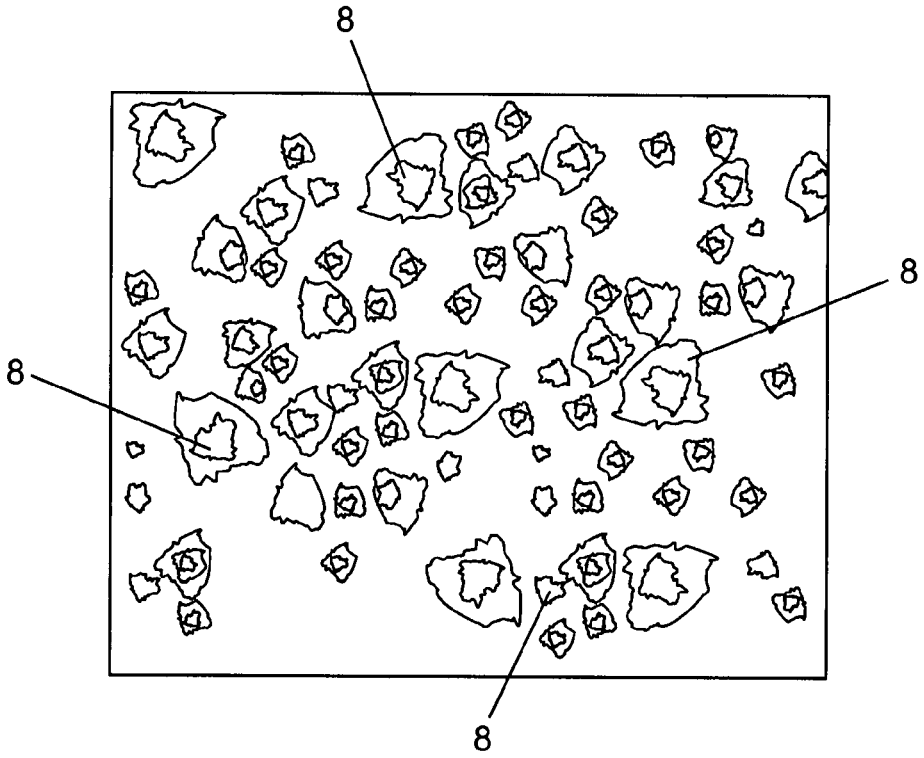
Figure 3:
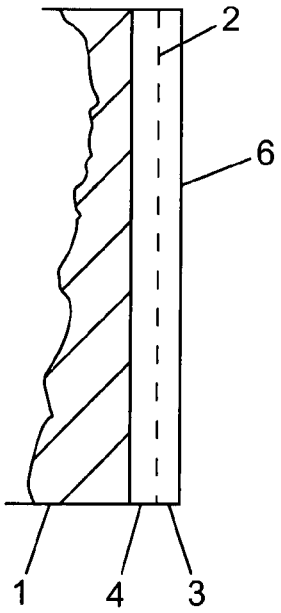
Figure 4:
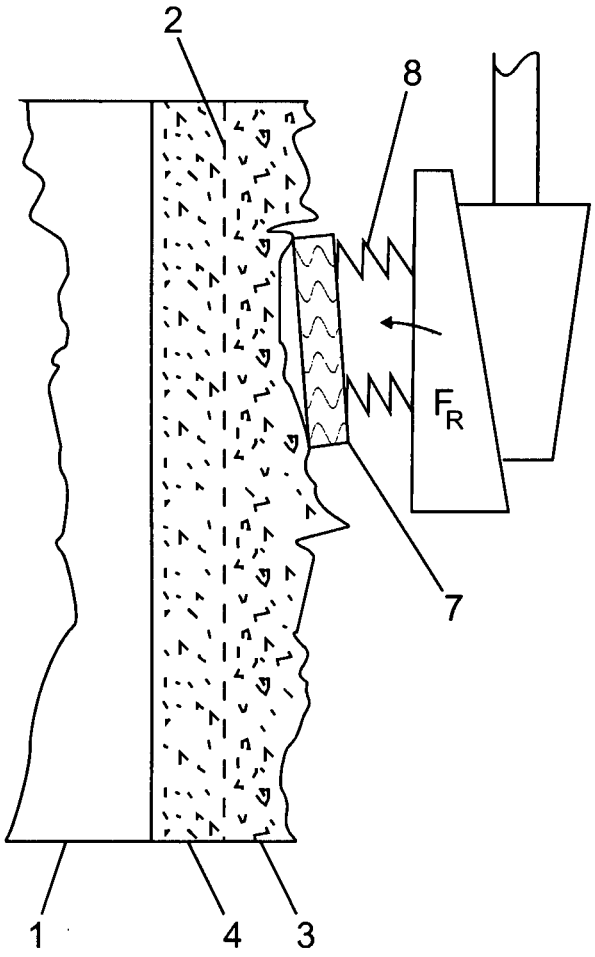

FIG. 2.1 shows the undulations in the layer;

FIG. 2.2 is a highly enlarged reproduction of the surface of the layer before smoothing;

FIG. 3 shows the bore surface line with a layer applied after smoothing;

FIG. 3.1 shows the undulations in the layer after smoothing;

FIG. 3.2 is s highly enlarged reproduction of the surface of the layer after smoothing; and FIG. 4 is a schematic view of a honing tool for smoothing.

FIG. 1 shows the surface line 2 of a (cylinder) bore premachined by honing. In this state, the substrate is activated for the subsequent coating and has the desired target shape.

FIG. 2 shows the surface after treatment by means of PED. From this figure, it is clear that approximately one third (reference sign 4) of the thickness of the coating 9 makes up a change in the rim zone of the substrate and approximately two thirds (reference sign 3) of said thickness produce a layer structure on the outside.

It should be noted the premachining dimensions of the bore (see the surface line 2) are such that the surface line 5 of the coating 9 is within the tolerance range of the finished bore.

FIG. 2.1 shows the undulations in the surface line 5 according to FIG. 2. The undulations are too great for many uses, and therefore a smoothing process also needs to be carried out in order to reduce the undulations.

FIG. 2.2 shows an SEM picture of the surface after coating. In this picture, the pores 8 of the coating are apparent.

FIG. 3 shows the smoothed surface line 6, which has for example been achieved by honing using the tool shown in FIG. 4. In this figure, the surface line has been smoothed such that a straight surface line 6 has been produced while retaining the pores 3. After smoothing, the smoothed surface line 8 is also within the tolerance range of the finished bore.

The surface of the smoothed surface line is also shown in FIG. 3.1 in the scanned section and in the SEM picture in FIG. 3.2.

FIG. 4 shows the principle of smooth-honing using a spring-mounted honing stone 7, at the start of the smooth-honing process. The radial action on the coating is produced by the radial force FR. Owing to the springs, the honing stone 7 has the option of reducing the shallow undulations in the coating without changing the target shape of the cylinder bore. During smoothing, the pore structures are largely retained.

The invention claimed is:

1. A method for producing a wear-resistant surface on or within a workpiece that is made of aluminum or an aluminum alloy, the method comprising the steps of:

a) premachining and thereby activating a surface of the workpiece by honing or precision boring the workpiece to produce an activated surface having a surface roughness Rz value ranging from 1 to 4 microns; and b) applying a wear-resistant coating onto the activated surface of the workpiece by means of electrolysis, said electrolysis by one of plasma electrolytic deposition (PED) or plasma electrolytic oxidation (PEO), to produce a wear-resistant coating having a surface roughness Rz ranging from 2 to 3 microns, a Rpk value ranging from 1.0 to 2.0 microns and pores, with said pores having a size ranging from 2 to 3 microns in the surface.

2. The method according to claim 1, wherein after the wear-resistant coating has been applied, the surface of the wear-resistant coating is smoothed, and wherein the porosity of the wear-resistant coating surface is retained after the wear-resistant coating surface has been smoothed and wherein the pores retain oil applied to the surface of the wear-resistant coating.

3. The method according to claim 2, wherein the surface of the wear-resistant coating is smoothed by honing the surface.

4. The method according to claim 3, wherein during the honing of the surface of the wear-resistant coating a layer of less than 5 μm of thickness of the surface is removed during the honing process.

5. The method according to claim 2, wherein the wear-resistant coating is smoothed using a smooth-honing tool having freely suspended honing segments.

6. The method according to claim 2, wherein the step of smoothing the surface produces a surface having a surface roughness, Rz, ranging from 2.0 to 2.5 microns.

7. The method according to claim 1, wherein the activated surface of the workpiece is subjected to an alkaline degreasing step prior to application of the wear-resistant coating onto the activated surface.

8. The method according to claim 1, wherein a cylindrical surface is produced in the workpiece during the premachining step.

9. The method according to claim 1, wherein the workpiece is made of a hypoeutectic aluminum alloy.

10. The method according to claim 1, wherein the premachining of the workpiece is used to produce a cylinder bore of an internal combustion engine in the workpiece and wherein the cylinder bore is coated with the wear-resistant coating.

11. The method according to claim 1, wherein the electrolysis step produces a wear-resistant coating comprising aluminum oxide.

* * * * *